US011692334B2

(12) United States Patent
Okada et al.

(10) Patent No.: US 11,692,334 B2
(45) Date of Patent: Jul. 4, 2023

(54) EXCAVATOR

(71) Applicant: SUMITOMO HEAVY INDUSTRIES, LTD., Tokyo (JP)

(72) Inventors: Junichi Okada, Yokosuka (JP); Masaru Onodera, Yokosuka (JP)

(73) Assignee: SUMITOMO HEAVY INDUSTRIES, LTD., Tokyo (JP)

( * ) Notice: Subject to any disclaimer, the term of this patent is extended or adjusted under 35 U.S.C. 154(b) by 455 days.

(21) Appl. No.: 16/584,923

(22) Filed: Sep. 26, 2019

(65) Prior Publication Data

US 2020/0024831 A1 Jan. 23, 2020

Related U.S. Application Data

(63) Continuation of application No. PCT/JP2018/010285, filed on Mar. 15, 2018.

(30) Foreign Application Priority Data

Mar. 31, 2017 (JP) ..... 2017-072627

(51) Int. Cl.

| | |
|---|---|
| ***E02F 9/26*** | (2006.01) |
| ***E02F 9/22*** | (2006.01) |
| *E02F 3/43* | (2006.01) |

(52) U.S. Cl.

CPC ..... *E02F 9/265* (2013.01); *E02F 9/2267* (2013.01); *E02F 9/2271* (2013.01); *E02F 9/2285* (2013.01); *E02F 3/431* (2013.01)

(58) Field of Classification Search

CPC ..... F15B 21/008; F15B 2211/8616; E02F 9/2207; E02F 9/2214

See application file for complete search history.

(56) References Cited

U.S. PATENT DOCUMENTS

| | | | | | |
|---|---|---|---|---|---|
| 5,048,296 | A * | 9/1991 | Sunamura | E02F 3/43 | 60/468 |
| 7,165,395 | B2 * | 1/2007 | Anderson | E02F 9/2207 | 60/413 |
| 7,269,947 | B2 * | 9/2007 | Yoshino | F15B 11/006 | 60/469 |
| 7,278,262 | B2 * | 10/2007 | Moon | E02F 9/2207 | 60/426 |
| 7,934,377 | B2 * | 5/2011 | Kim | E02F 9/2292 | 60/469 |
| 8,972,122 | B2 * | 3/2015 | Magaki | E02F 9/2033 | 701/50 |
| 9,249,556 | B2 | 2/2016 | Magaki et al. | | |

(Continued)

FOREIGN PATENT DOCUMENTS

| | | | |
|---|---|---|---|
| JP | 01163323 A | * | 6/1989 |
| JP | H01-163323 A | | 6/1989 |

(Continued)

*Primary Examiner* — Thomas E Lazo

(74) *Attorney, Agent, or Firm* — HEA Law PLLC

(57) ABSTRACT

An excavator includes a traveling body, an upper turning body rotatably provided on the traveling body, an attachment which has a boom, an arm, and a bucket and is attached to the upper turning body, and a controller configured to perform a control of a cylinder of at least one shaft of the attachment so as to suppress a vibration of the traveling body or the upper turning body, which is caused by an aerial operation of the attachment.

15 Claims, 13 Drawing Sheets

(56) References Cited

U.S. PATENT DOCUMENTS

| | | | | |
|---|---|---|---|---|
| 9,644,339 | B2 * | 5/2017 | Wada | E02F 9/2207 |
| 9,651,112 | B2 * | 5/2017 | Huang | B66C 13/066 |
| 10,087,599 | B2 * | 10/2018 | Tsukamoto | E02F 3/435 |
| 10,422,109 | B2 * | 9/2019 | Kawashima | E02F 9/22 |
| 2014/0150416 | A1 * | 6/2014 | Lee | F15B 11/006 60/327 |

FOREIGN PATENT DOCUMENTS

| | | | | | |
|---|---|---|---|---|---|
| JP | H05-131829 | A | | 5/1993 | |
| JP | H07-10065 | U | | 2/1995 | |
| JP | H07-14204 | U | | 3/1995 | |
| JP | 08013546 | A | * | 1/1996 | |
| JP | H08-13546 | A | | 1/1996 | |
| JP | 09041428 | A | * | 2/1997 | E02F 9/2207 |
| JP | H09-41428 | A | | 2/1997 | |
| JP | H11-173308 | A | | 6/1999 | |
| JP | H11-343095 | A | | 12/1999 | |
| JP | 2003-184133 | A | | 7/2003 | |
| JP | 2003184133 | A | * | 7/2003 | E02F 9/2207 |
| JP | 2009-180065 | A | | 8/2009 | |
| JP | 2009180065 | A | * | 8/2009 | |
| JP | 2012-172382 | A | | 9/2012 | |
| JP | 2012172382 | A | * | 9/2012 | |
| JP | 2014-122510 | A | | 7/2014 | |
| WO | 2012/121253 | A1 | | 9/2012 | |

* cited by examiner

EXCAVATOR

RELATED APPLICATIONS

The contents of Japanese Patent Application No. 2017-072627, and of International Patent Application No. PCT/JP2018/010285, on the basis of each of which priority benefits are claimed in an accompanying application data sheet, are in their entirety incorporated herein by reference.

BACKGROUND

Technical Field

Certain embodiments of the present invention relate to an excavator.

Description of Related Art

An excavator mainly includes a traveling body (also referred to as crawler or lower), an upper turning body, and an attachment. The upper turning body is rotatably attached to the traveling body, and a position of the upper turning body is controlled by a turning motor. The attachment is attached to the upper turning body and is used during a work.

An operator controls a boom, an arm, and a bucket of the attachment according to work contents. However, in this case, a vehicle body (that is, traveling body, the upper turning body) receives a reaction force via the attachment from a ground or a structure with which the bucket is in contact. A body of the excavator may be lifted according to a direction in which the reaction force is applied, a posture of the vehicle body, and a condition of the ground. In the related art, a technology for preventing the lifting of the vehicle body by suppressing a pressure of a shrinkage side (rod side) of a boom cylinder is disclosed.

SUMMARY

According to an embodiment of the present invention, there is provided an excavator including: a traveling body; an upper turning body which is rotatably provided on the traveling body; an attachment which has a boom, an arm, and a bucket, and is attached to the upper turning body; and a vibration suppressing unit which corrects an operation of the attachment to suppress a vibration of the traveling body caused by an aerial operation of the attachment.

According to still another embodiment of the present invention, there is provided an excavator including: a traveling body; an upper turning body which is rotatably provided on the traveling body; an attachment which is attached to the upper turning body; a hydraulic cylinder which operates the attachment; and a relief valve which relives oil in the hydraulic cylinder. A first state in which a vibration generated when the earth removal is performed by the attachment or when the attachment is shifted from a movement state to a stop state in air is reduced and a second state in which the first state is released are provided, and the vibration generated when the earth removal is performed by the attachment or when the attachment is shifted from the movement state to the stop state in air in the second state is larger than the vibration generated in the first state. For example, the excavator may include a button and an interfaces which performs switching between the first state and the second state.

DETAILED DESCRIPTION

Figure 1:
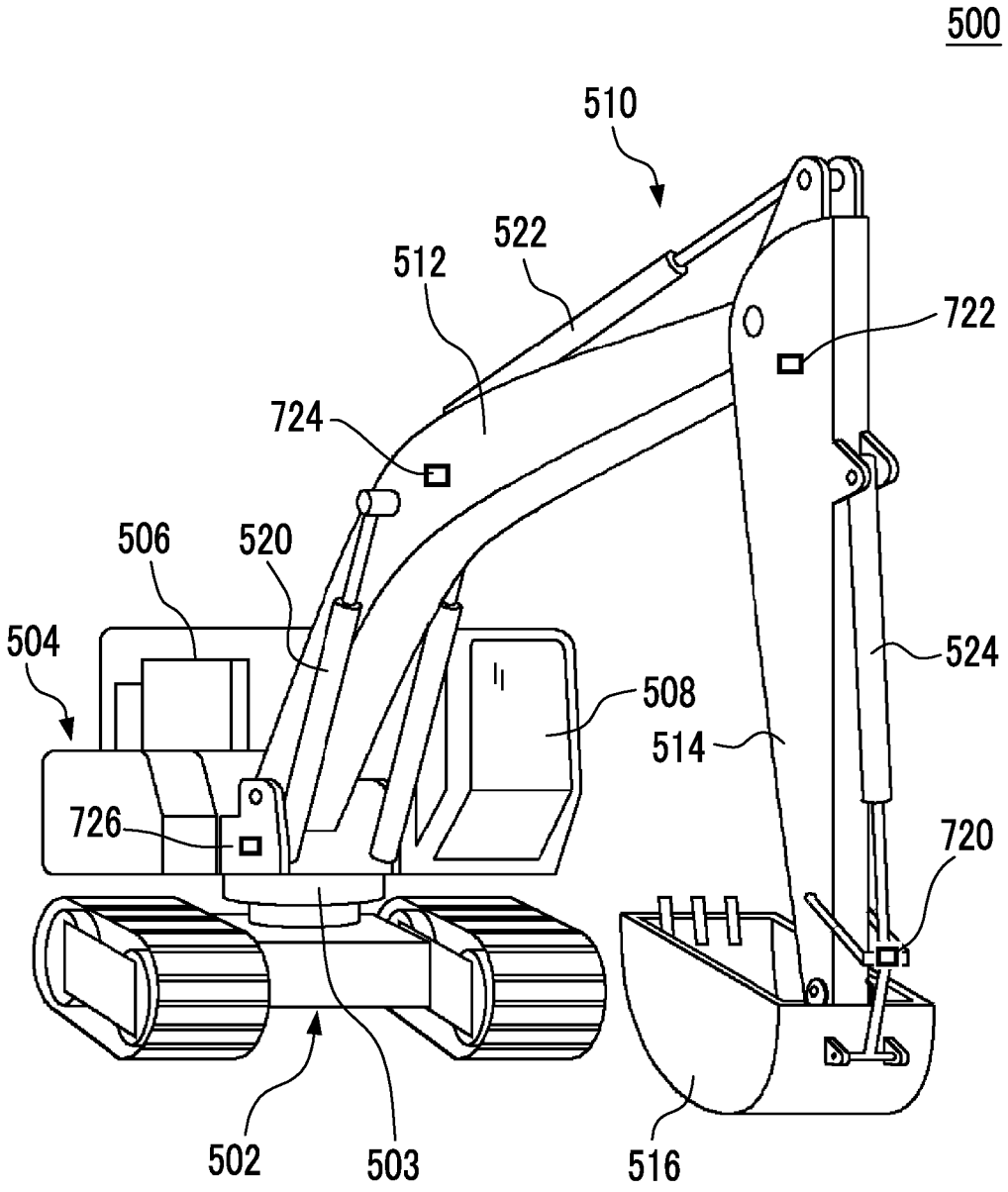
FIG. 1 is a perspective view showing an appearance of an excavator which is an example of a construction machine.

It is desirable to provide an excavator capable of suppressing vibration of a vehicle body and/or suppressing overturn of the vehicle body.

According to aspects of the present invention, a force generated by the aerial operation of an attachment, that is, an overturning moment is absorbed using at least one shaft of the attachment, and thus, it is possible to prevent a force vibrating the vehicle body in a pitching direction from being propagated from the attachment to a traveling body, and it is possible to eventually suppress the vibration.

A vibration suppressing unit may correct an operation of a boom cylinder of the attachment. Accordingly, it is possible to suppress not only a vibration caused by a movement of the boom cylinder but also vibrations caused by operations of both the arm and the bucket located on a distal end side from the boom cylinder.

The vibration suppressing unit may be operated such that a thrust force of a control target cylinder does not exceed an upper limit value according to a state of the attachment.

The vibration suppressing unit may acquire the upper limit value of the thrust force of the control target cylinder by a calculation using the state of the attachment as an input.

The vibration suppressing unit may include a table which has the state of the attachment as the input and the upper limit value of the thrust force of the control target cylinder as an output, and may set the upper limit value of the thrust force of the control target cylinder with reference to the table.

The vibration suppressing unit may suppress a pressure on a bottom side of the cylinder such that the pressure on the bottom side is equal to or less than a threshold calculated from the upper limit value of the thrust force of the cylinder and a pressure on a rod side of the cylinder.

The excavator may further include an electromagnetic port relief valve provided on the bottom side of the control target cylinder, and the vibration suppressing unit may control the electromagnetic port relief valve.

The excavator may further include an external regeneration valve provided between a bottom chamber and a rod chamber of the control target cylinder and the vibration suppressing unit may control the external regeneration valve.

The excavator may further include an electromagnetic control valve provided in an oil passage leading to a tank chamber from the bottom chamber of the control target cylinder and the vibration suppressing unit may control the electromagnetic control valve.

When any shaft is operated, a controller may control a cylinder of a shaft which is not operated.

The controller may change a state between an oil chamber of the control target cylinder and a hydraulic circuit of the cylinder to a state where the oil more easily flows.

The controller may be operated such that the thrust force or the pressure in the control target cylinder does not exceed the upper limit value according to the state of the attachment.

The excavator may further include an electromagnetic port relief valve provided on the bottom side or the rod side of the control target cylinder, and the controller may control the electromagnetic port relief valve.

A controller may control include the control target cylinder and a valve provided in a control valve.

The excavator may further include an external regeneration valve which is provided between the bottom chamber and the rod chamber of the control target cylinder and the controller may control the external regeneration valve.

The excavator may further include an electromagnetic control valve which is provided in an oil passage leading to the tank chamber from the bottom chamber of the control target cylinder. The controller may control the electromagnetic control valve.

The control by the controller may be effective in a non-traveling state or a non-turning state of the excavator. In particular, if the attachment is automatically activated in a situation where the attachment is easy to operate, a burden on an operator can be reduced.

The control by the controller may be effective when a position of the bucket is included in the predetermined region. It is useable in such a situation because the vehicle body is easily vibrated/lifted by an external force as the position of the bucket is away from the vehicle body or is higher than that of the vehicle body.

The controller may calculate a stability of the vehicle body, and may cause the control to be effective in a state where the stability is low. Since the vehicle body is easily vibrated or lifted easily in the state where the stability is low, and, particularly, in such a state, it is effective if the vibration/moment change of the attachment is not easily transmitted to the vehicle body.

An operation unit associated with an operation panel or a display device may provide an input for turning on or off a function related to the control by the controller. For the experienced operator of the excavator, since a rather troublesome scene is assumed, it is possible to decide whether or not the operator himself/herself operates.

The controller may perform the control such that the control target cylinder is freely operated. A moveable unit in the cylinder moves according to a change in the moment of the attachment, and this change can be absorbed.

In addition, aspects of the present invention include any combination of the above-described elements and mutual substitution of elements or expressions of the present invention among methods, apparatuses, systems, or the like.

According to the present invention, it is possible to suppress a vibration of an excavator.

Hereinafter, preferred embodiments of the present invention will be described with reference to the drawings. Identical or equivalent constituent elements, members, and processes shown in the drawings are denoted by the same reference numerals and overlapping descriptions thereof will be appropriately omitted. In addition, the embodiments do not limit the invention and are merely examples, and all the features and combinations thereof described in the embodiments are not necessarily essential to the invention.

FIG. 1 is a perspective view showing an appearance of an excavator 500 which is an example of a construction machine. The excavator 500 mainly includes a lower traveling body (crawler) 502 and an upper turning body 504 which is rotatably mounted on an upper portion of the lower traveling body 502 via a turning mechanism 503.

An attachment 510 is attached to the upper turning body 504. The attachment 510 includes a boom 512, an arm 514 which is link-connected to a distal end of the boom 512, and a bucket 516 which is link-connected to a distal end of the arm 514. The boom 512, the arm 514, and the bucket 516 are respectively driven hydraulically by a boom cylinder 520, an arm cylinder 522, and a bucket cylinder 524. In addition, in the upper turning body 504, a cab 508 in which an operator is accommodated or a power source such as an engine 506 for generating a hydraulic pressure are provided.

Sensor 720, 722, 724, and 726 are provided in the attachment 510 or the vehicle body of the excavator. Each of the sensors may be an inertial measurement unit (IMU) including a three-axis acceleration sensor and a three-axis gyro sensor. Based on outputs of the sensors, a position of the bucket 516, a posture of the attachment 510, or the like can be detected.

Subsequently, a vibration caused by an aerial operation of the excavator 500 will be described in detail.

The present inventors examined the excavator shown in FIG. 1 and reached to recognize the following problems. During an operation (hereinafter, referred to as an aerial operation) in which a bucket is not in contact with a ground, a moment of inertia of an attachment may induce a vibration in a traveling body (vehicle body) of the excavator. For example, when earth and sand are discharged from the bucket, the moment of inertia is changed. In this case, the attachment acts on the vehicle body of the excavator to tilt the vehicle body in a forward direction and induces the vibration of the vehicle body. In some cases, a portion of the vehicle body may be lifted. Moreover, this problem or phenomenon should not be taken as a general recognition of a person skilled in the art.

Figure 2A:
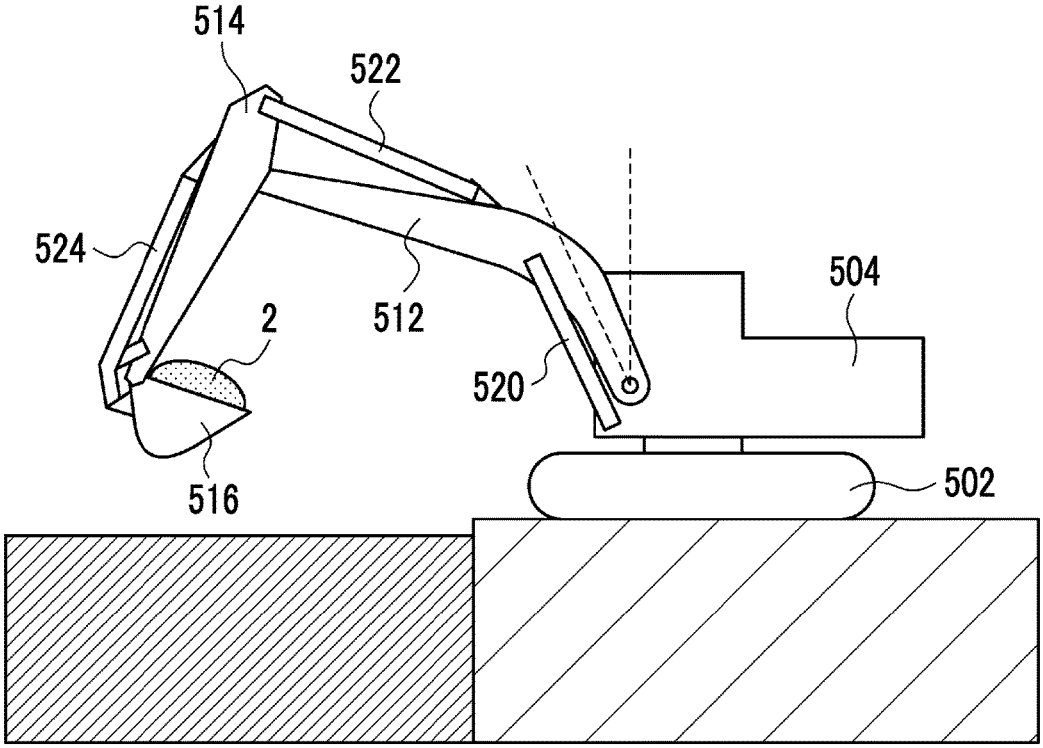
FIGS. 2A and 2B are views showing an example of a vibration generated during an aerial operation of the excavator.
Figure 2B:
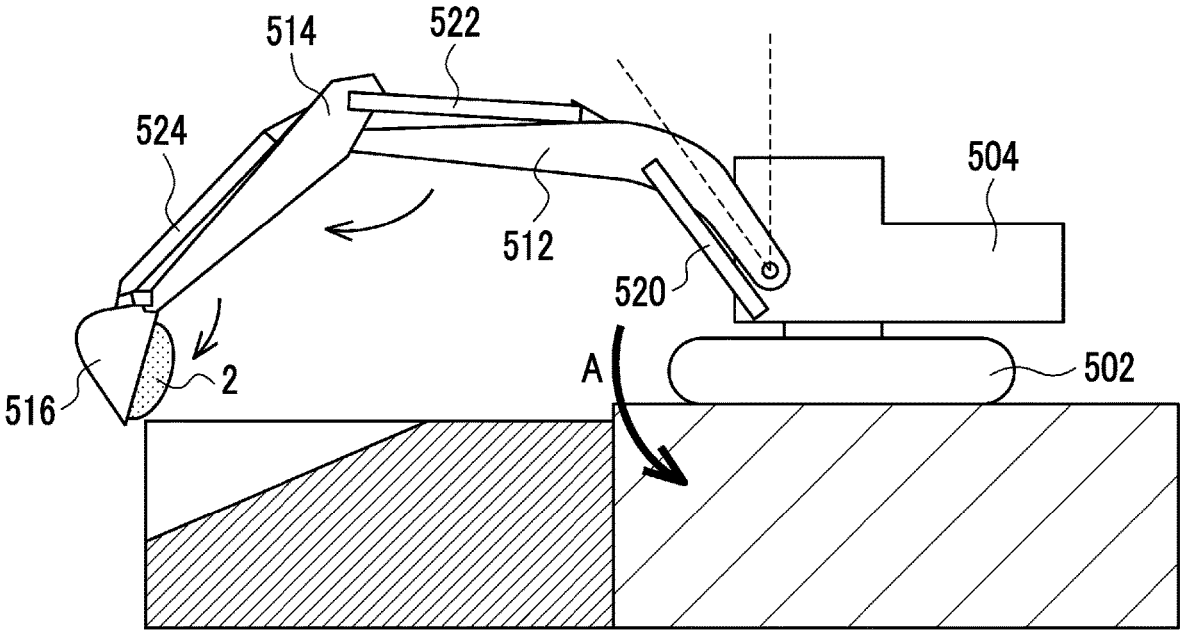

FIGS. 2A and 2B are views showing an example of the vibration generated during the aerial operation of the excavator. Here, a discharge operation will be described as an example of the aerial operation. In FIG. 2A, the bucket 516 and the arm 514 are closed, the boom 512 is in a raised state, and the bucket 516 accommodates a load 2 such as the earth and sand. As shown in FIG. 2B, in the discharge operation, the bucket 516 and the arm 514 is widely opened, and the load is discharged. In this case, a change in the moment of inertia of the attachment 510 acts on the vehicle body of the excavator 500 to vibrate the vehicle body in a pitching direction shown by an arrow A in FIG. 2B.

Figure 3:
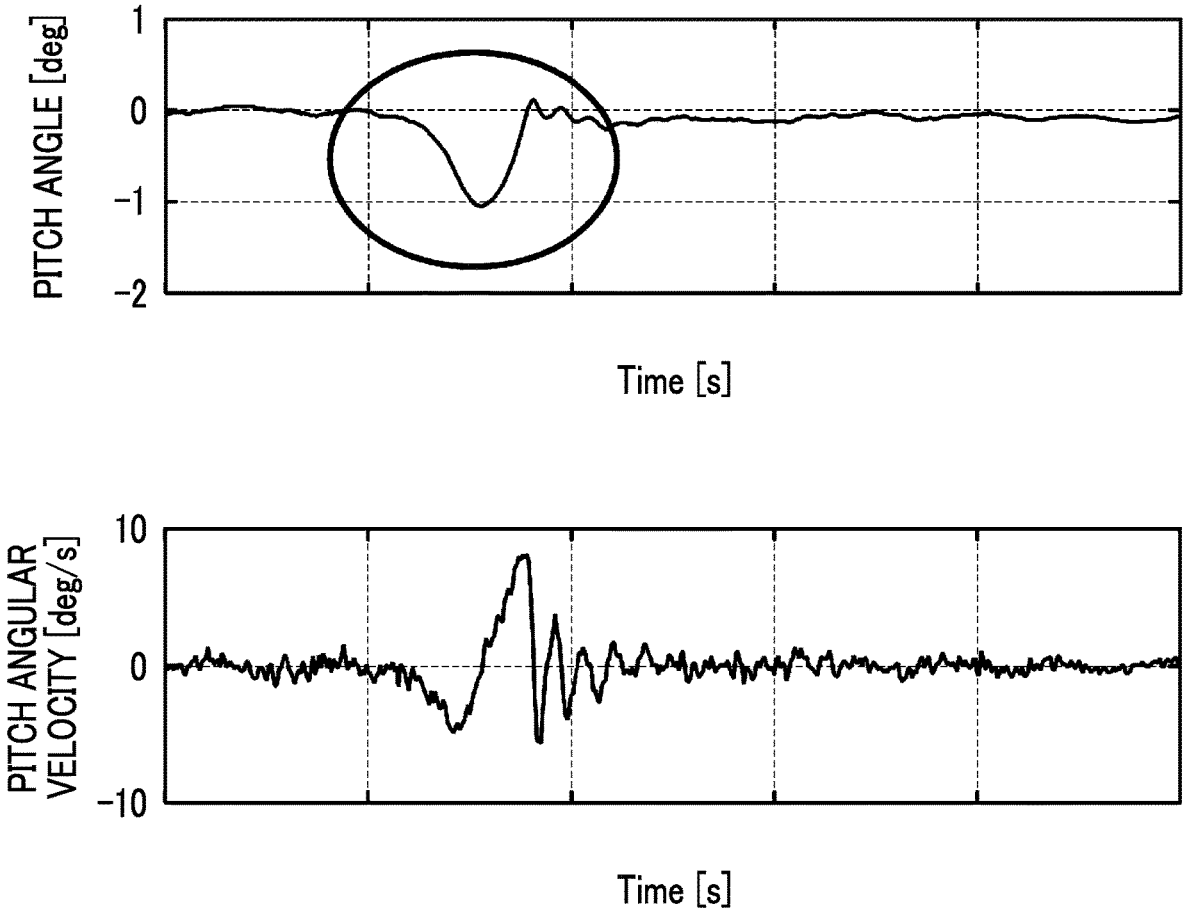
FIG. 3 is a diagram showing time waveforms of an angle and an angular velocity in a pitching axis direction of the excavator measured when a discharge operation is performed.

FIG. 3 is a diagram showing time waveforms of an angle (pitch angle) and an angular velocity (pitch angular velocity) in the pitching axis direction of the excavator 500 measured when a discharge operation is performed. It can be seen from FIG. 3 that an overturning moment for overturning the excavator is generated due to the aerial operation and a vibration around a pitch axis is generated. Hereinafter, a method of suppressing the vibration caused by the aerial operation and an excavator capable of suppressing the vibration will be described.

First, a principle of the vibration suppression will be described. In the present embodiment, a force caused by the operation of the attachment is absorbed by using a cylinder provided in the attachment itself as a cushion.

Figure 4A:
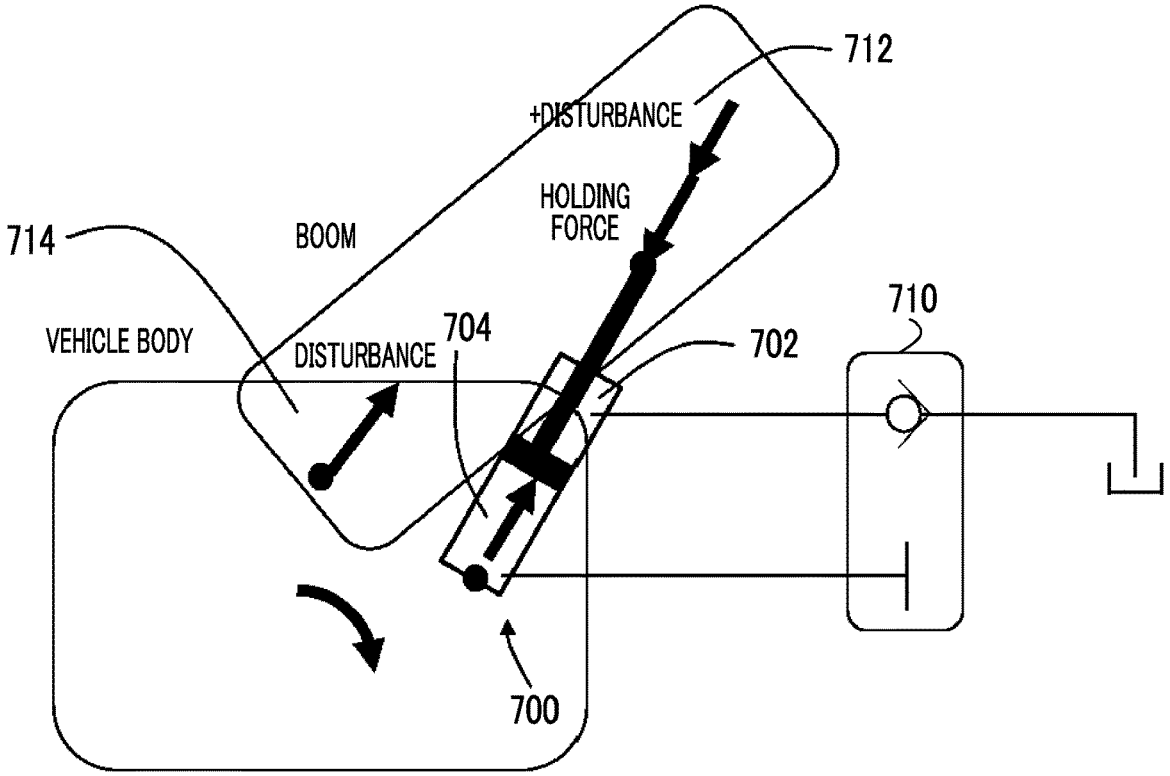
FIGS. 4A and 4B are diagrams for explaining vibration suppression by a cylinder.
Figure 4B:
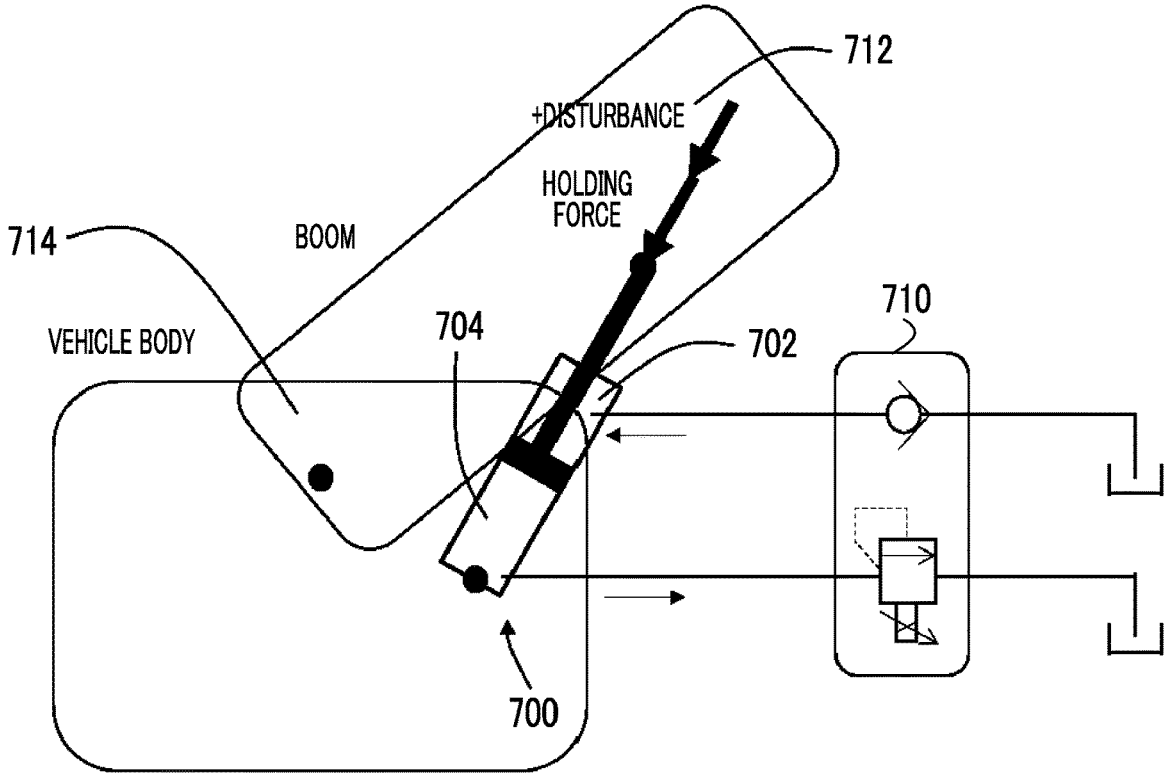

FIGS. 4A and 4B are diagrams for explaining the vibration suppression by a cylinder. FIG. 4A shows a state where a cushion function is not exerted. In general, in a cylinder 700 corresponding to an operating shaft (for example, boom), when an operation is not performed, both a rod chamber 702 and a bottom chamber 704 are substantially separated from a hydraulic circuit 710. Accordingly, a piston in the cylinder 700 is not moved, and a vibration 712 of the attachment is directly transmitted to the vehicle body side.

FIG. 4B shows a state where the cushion function is exerted. If the vibration 712 is generated in a direction in which the cylinder 700 of the boom stretches or shrinks, even in a state where the operation is not performed, the hydraulic system is controlled such that a pressure of at least one of the bottom chamber 704 and the rod chamber 702 is released or oil flows to at least one thereof. Thereby, the cylinder 700 plays a role as the cushion and absorbs an inertial force or the vibration, and transmission of the inertial force or the vibration to the vehicle body side is suppressed. Energy of the vibration or the inertial force is consumed in the cylinder by a friction or the like of an oil passage connected to the cylinder. In addition, if only the inertial force is considered, it is enough to only cause oil to flow out from the bottom chamber 704. However, in general, a reaction of a pressure change in the cylinder is generated, and thus, it is also preferable to cause the oil to flow out from the rod chamber 702.

Figure 5:
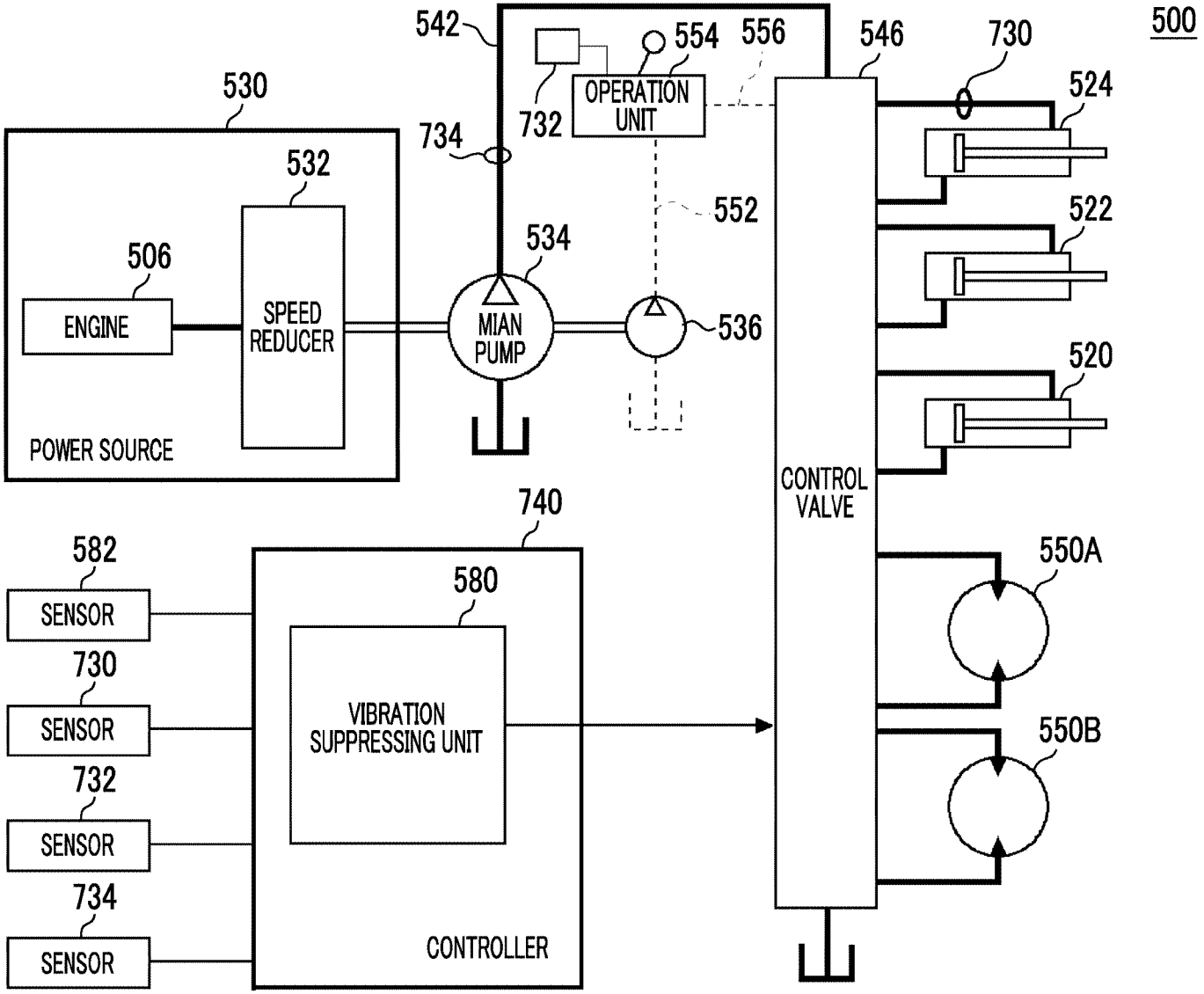
FIG. 5 is a block diagram of an electric system, a hydraulic system, or the like of the excavator.

FIG. 5 is a block diagram of an electric system, a hydraulic system, or the like of the excavator 500. In addition, in FIG. 5, a system which mechanically transmits power is indicated by a double line, a hydraulic system is indicated by a thick solid line, a steering system is indicated by a broken line, and an electric system is indicated by a thin solid line.

A rotation of the engine 506 is transmitted to a main pump 534 via a speed reducer 532. Instead of the engine 506 and the speed reducer 532, an electric power source (motor) may be used, or a hybrid of the engine and the motor may be used. The main pump 534 and a pilot pump 536 are connected to an output shaft of the speed reducer 532, and a control valve 546 is connected to the main pump 534 via a high pressure hydraulic line 542. The control valve 546 is a device which controls a hydraulic system in the excavator 500. In addition to hydraulic motors 550A and 550B for driving the lower traveling body 502 shown in FIG. 1, the boom cylinder 520, the arm cylinder 522, and the bucket cylinder 524 are connected to the control valve 546 via a high pressure hydraulic line, and the control valve 546 controls a hydraulic pressure supplied to them in accordance with an operation input of a driver.

An operation unit 554 is connected to the pilot pump 536 via a pilot line 552. The operation unit 554 is a lever or a pedal for operating a turning motor 560, the lower traveling body 502, the boom 512, the arm 514, and the bucket 516 and is operated by the operator. Specifically, each shaft (boom 512, arm 514, and bucket 516) of the attachment 510 is operated in conjunction with an operation of the operation unit 554 provided in a driver's seat. Specifically, if the lever is operated, each of the boom cylinder 520, the arm cylinder 522, and the bucket cylinder 524 stretches or shrinks according to the operation, and thus, the boom 512, the arm 514, and the bucket 516 are operated.

The control valve 546 is connected to the operation unit 554 via a hydraulic line 556. The operation unit 554 converts a hydraulic pressure (primary-side hydraulic pressure) supplied through the pilot line 552 into a hydraulic pressure (secondary-side hydraulic pressure) according to a manipulated variable of the operator and outputs the converted hydraulic pressure. The secondary-side hydraulic pressure output from the operation unit 554 is supplied to the control valve 546 through the hydraulic line 556.

The sensor 730 measures a bottom side pressure and a rod side pressure of each of the cylinders 520, 522, and 524. The sensor 732 monitors the operation input with respect to each shaft and acquires operation information. For example, the sensor 732 may acquire the operation information based on a pilot pressure or may convert information from an electric lever into electrical information. The pressure sensor 734 measures the pressure of the high pressure hydraulic line 542. The outputs of the sensors 730, 732, 734 are supplied to a controller 740.

Subsequently, an outline of the vibration suppression will be described. In the excavator 500, the controller 740 (vibration suppressing unit 580 described later) automatically performs correction when the vibration is likely to occur or the moment of inertia is likely to be changed during the aerial operation of the attachment 510. The vibration of the attachment 510 is absorbed by the correction and the vibration transmitted to the vehicle body is reduced. In the correction, the state is shifted to a state (a state where the oil chamber of the cylinder and the oil passage communicate with each other) where oil flows out from an oil chamber inside at least one of the cylinders 520, 522, and 524, for example, the boom cylinder 520. The vibration of the attachment 510 caused by the change of the moment or the change of the moment itself is transmitted to boom cylinder 520, and as a result, the oil in boom cylinder 520 is discharged, and thus, the vibration is attenuated.

Moreover, the correction is performed during the aerial operation, and thus, the controller 740 determines whether or not the operation is the aerial operation and automatically shifts the state to a control state where the vibration generated during the aerial operation of the attachment is easily not transmitted to the vehicle body side. In addition, since it may affect other works if the state is always in this state, the state may be shifted to the control state under a predetermined condition.

Hereinafter, the vibration suppression will be specifically described. The vibration suppressing unit 580 corrects the operation of the attachment 510 so that the vibration of the traveling body caused by the aerial operation is suppressed. More specifically, the vibration suppressing unit 580 sets at least one of the boom cylinder 520, the arm cylinder 522, and the bucket cylinder 524 to a control target so as to be applied to the control target cylinder, and corrects the operation of the attachment 510.

More specifically, the vibration suppressing unit 580 performs a control so that a thrust force of the control target cylinder does not exceed an upper limit value (limit thrust force) according to the state of the attachment 510. The upper limit value may be set appropriately from a force (referred to as an overturning moment) to overthrow the excavator calculated or estimated from the state of the attachment 510. For example, the overturning moment can be calculated theoretically from an angle of the arm, an angle of the boom, weight in the bucket, an angle of the bucket, tilt angle information, a relative angle between the lower traveling body and the turning body, pressure information of each cylinder, or the like. The vibration suppressing unit 580 can acquire information from various sensors 582. Various detection signals indicating the state (arm angle, boom angle, bucket angle, pitch angle, loaded weight of bucket, or the like) of the attachment 510 are input to the sensors 582. The number of sensors 582 may be determined by trade-off between a cost and accuracy of a calculation of the overturning moment. In addition, the state of the attachment 510 can include orientation of attachment, that is, a relative angle between the turning body and the traveling body. Information related to the vibration or lifting of the vehicle body may be directly acquired from position information, velocity information, acceleration information, or the like of the vehicle body (traveling body, turning body).

In FIG. 5, a control line from the vibration suppressing unit 580 toward the control valve 546 is drawn. However, this does not limit that the vibration suppressing unit 580 sets only the control valve 546 to the control target. The control target of the vibration suppressing unit 580 will be described later.

According to the excavator 500, the overturning moment, the vibration, or the change of the moment generated by the aerial operation of the attachment 510 is absorbed using at least one shaft of the attachment 510, and thus, it is possible to prevent the force vibrating the vehicle body to the pitching side from being propagated from the attachment 510 to the traveling body 502, and it is possible to suppress the vibration.

Figure 6A:
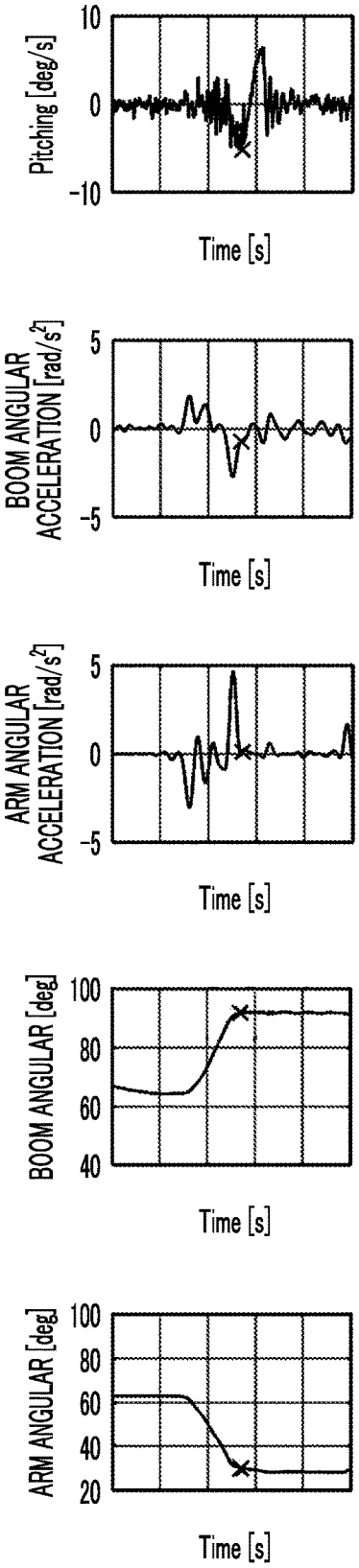
FIGS. 6A to 6C are operation waveform diagrams when an operator repeatedly performs the aerial operation on an actual excavator.
Figure 6B:
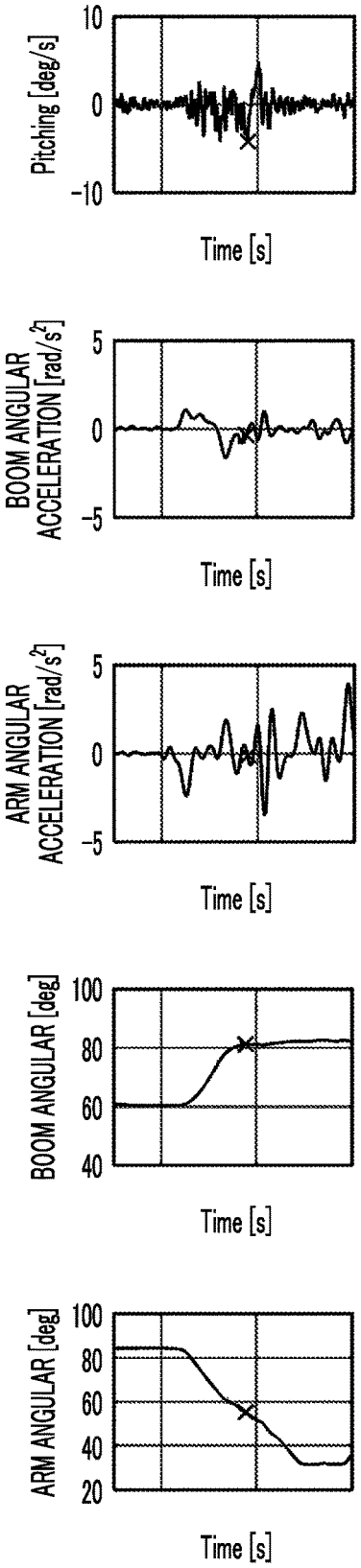
Figure 6C:
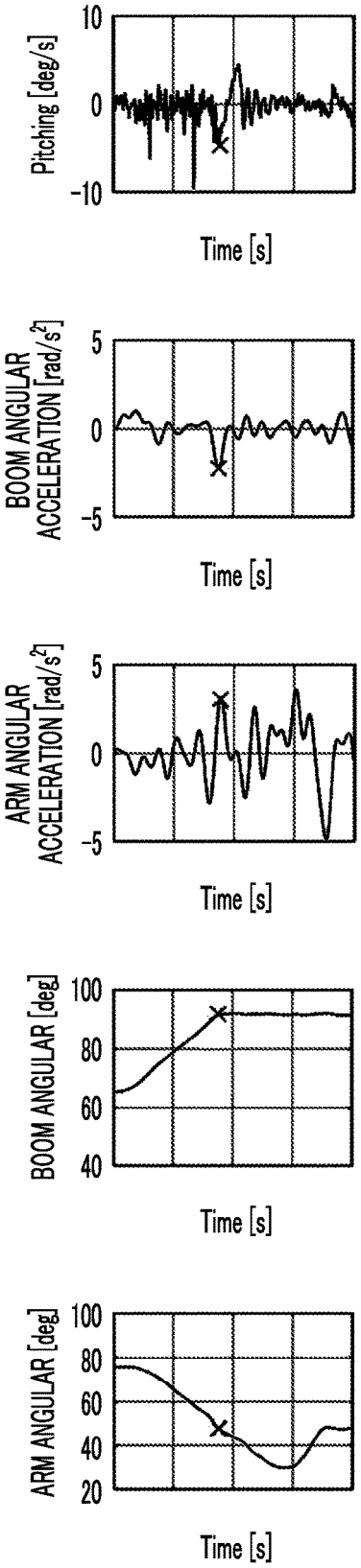

Subsequently, specific control and configuration effective for the vibration suppression will be described. FIGS. 6A to 6C are operation waveform diagrams when an operator repeatedly performs the aerial operation on an actual excavator. FIGS. 6A to 6C show trials different from each other, and from above, a pitch angular velocity (that is, the vibration of the vehicle body), a boom angular acceleration, an arm angular acceleration, a boom angle, and an arm angle are shown. In FIGS. 6A to 6C, X marks indicate points corresponding to negative peaks of the pitch angular velocity.

In FIGS. 6A to 6C, it can be seen that the vibration is induced when the change of the boom angle stops. In other words, it can be said that boom angular acceleration has a largest influence on occurrence of the vibration, and when viewed the opposite side, it can be said that the boom angular velocity is most effective for suppression of the vibration. This means that it is intuitively understood that while only a mass of the bucket affects the moment of inertia (inertia) with respect to the bucket angle and the masses of the bucket and the arm affect the moment of inertia with respect to the arm angle, not only the boom but also all the masses of the boom and bucket affect the moment of inertia with respect to the boom angle.

Accordingly, it is preferable that the vibration suppressing unit 580 corrects the operation with the boom cylinder 520 of the attachment 510 as the control target. That is, the vibration suppressing unit 580 may be operated such that a thrust force of the boom cylinder 520 does not exceed the upper limit value (limit thrust force) based on the state of the attachment 510.

Figure 7:
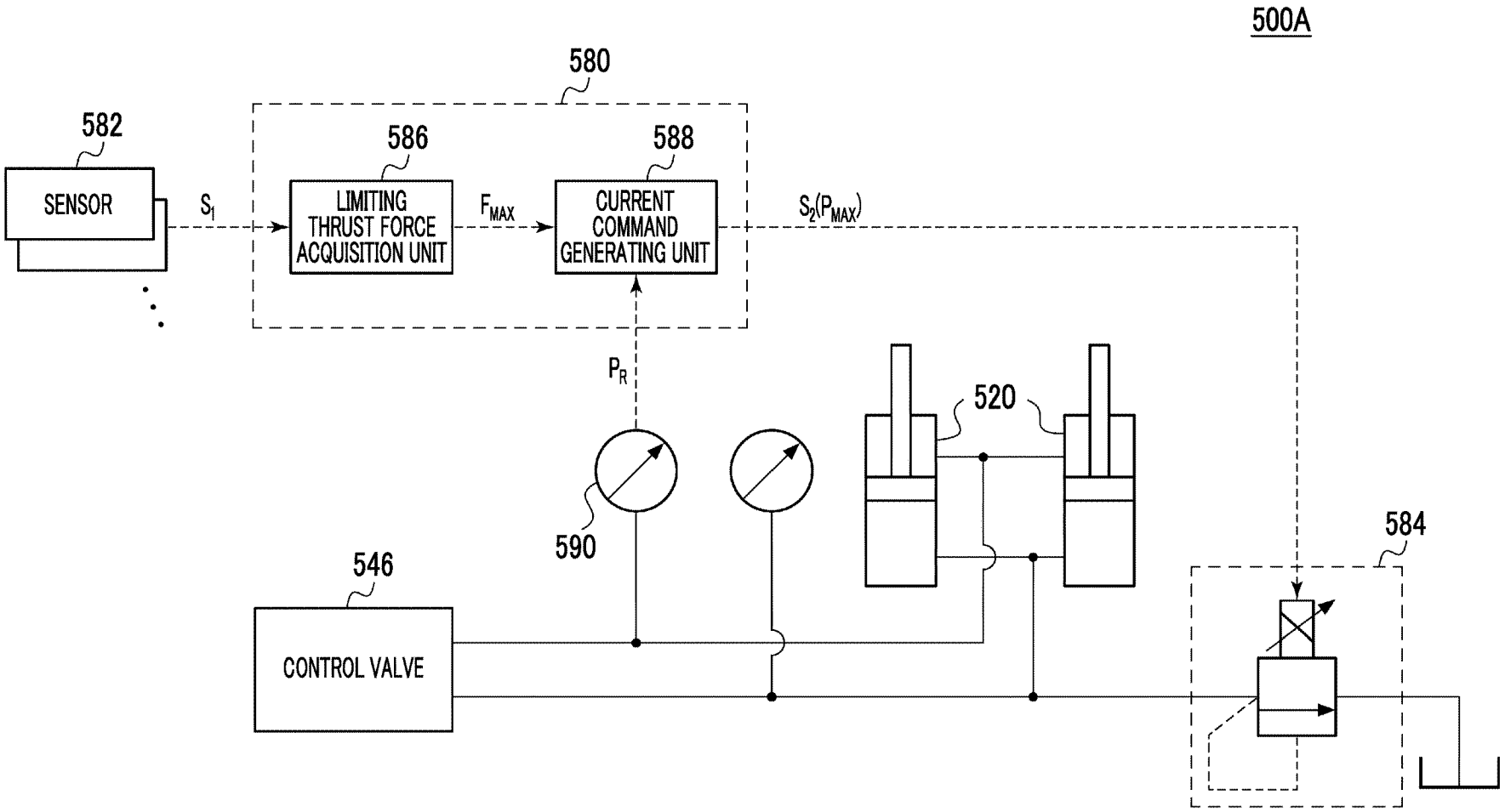
FIG. 7 is a block diagram related to a vibration suppression of the excavator according to an embodiment.

FIG. 7 is a block diagram related to a vibration suppression of an excavator 500A according to an embodiment. The excavator 500A further includes an electromagnetic port relief valve 584 which is provided on the bottom side of the control target boom cylinder 520. The vibration suppressing unit 580 controls the electromagnetic port relief valve 584 to limit the thrust force of the boom cylinder 520.

The vibration suppressing unit 580 includes a limiting thrust force acquisition unit 586 and a current command generating unit 588. The limiting thrust force acquisition unit 586 acquires a limit thrust force $F_{MAX}$ based on a detection signal $S_1$ from the sensor 582. In an embodiment, the limiting thrust force acquisition unit 586 acquires the limit thrust force $F_{MAX}$ by a calculation using the state (that is, the detection signal from the sensor 582) of the attachment 510 as an input.

When a pressure receiving area on the rod side is indicated by $A_R$, a pressure on the rod side is indicated by $P_R$, a pressure receiving area on the bottom side is indicated by $A_B$, and a pressure on the bottom side is indicated by $P_B$, a thrust force F of the boom cylinder 520 is expressed by the following Expression.

$$F=A_B \cdot P_B - A_R \cdot P_R$$

When the limit thrust force is indicated by $F_{MAX}$, since $F_{MAX} > A_B \cdot P_B - A_R \cdot P_R$ is satisfied, $P_B < (F_{MAX} + A_R \cdot P_R)/A_B$ is obtained.

That is, $(F_{MAX} + A_R \cdot P_R)/A_B$ becomes an upper limit value $P_{MAX}$ of a bottom pressure.

A rod pressure sensor 590 detects a pressure $P_R$ on a rod chamber side of the boom cylinder 520. The vibration suppressing unit 580 suppresses the pressure $P_B$ on the bottom side such that the pressure $P_B$ is equal to or less than the threshold $P_{MAX}$ calculated from the limit thrust force $F_{MAX}$ and the rod pressure $P_R$. Specifically, the current command generating unit 588 calculates the upper limit value $P_{MAX}$ of the bottom pressure $P_B$ from the limit thrust force $F_{MAX}$ and the rod pressure $P_R$, and supplies a current command $S_2$ corresponding to the upper limit value $P_{MAX}$ to the electromagnetic port relief valve 584.

According to this configuration, when the aerial operation of the attachment 510 generating the vibration occurs, the electromagnetic port relief valve 584 is opened, the thrust force of the boom cylinder 520 is limited, and the vibration is suppressed.

In addition, if the limit thrust force $F_{MAX}$ is reduced too much, the boom 512 is lowered. Therefore, the limiting thrust force acquisition unit 586 may acquire a thrust force (holding thrust force $F_{MIN}$) capable of holding a posture of the boom 512 and set the limit thrust force $F_{MAX}$ within a range higher than the holding thrust force $F_{MIN}$.

Figure 8:
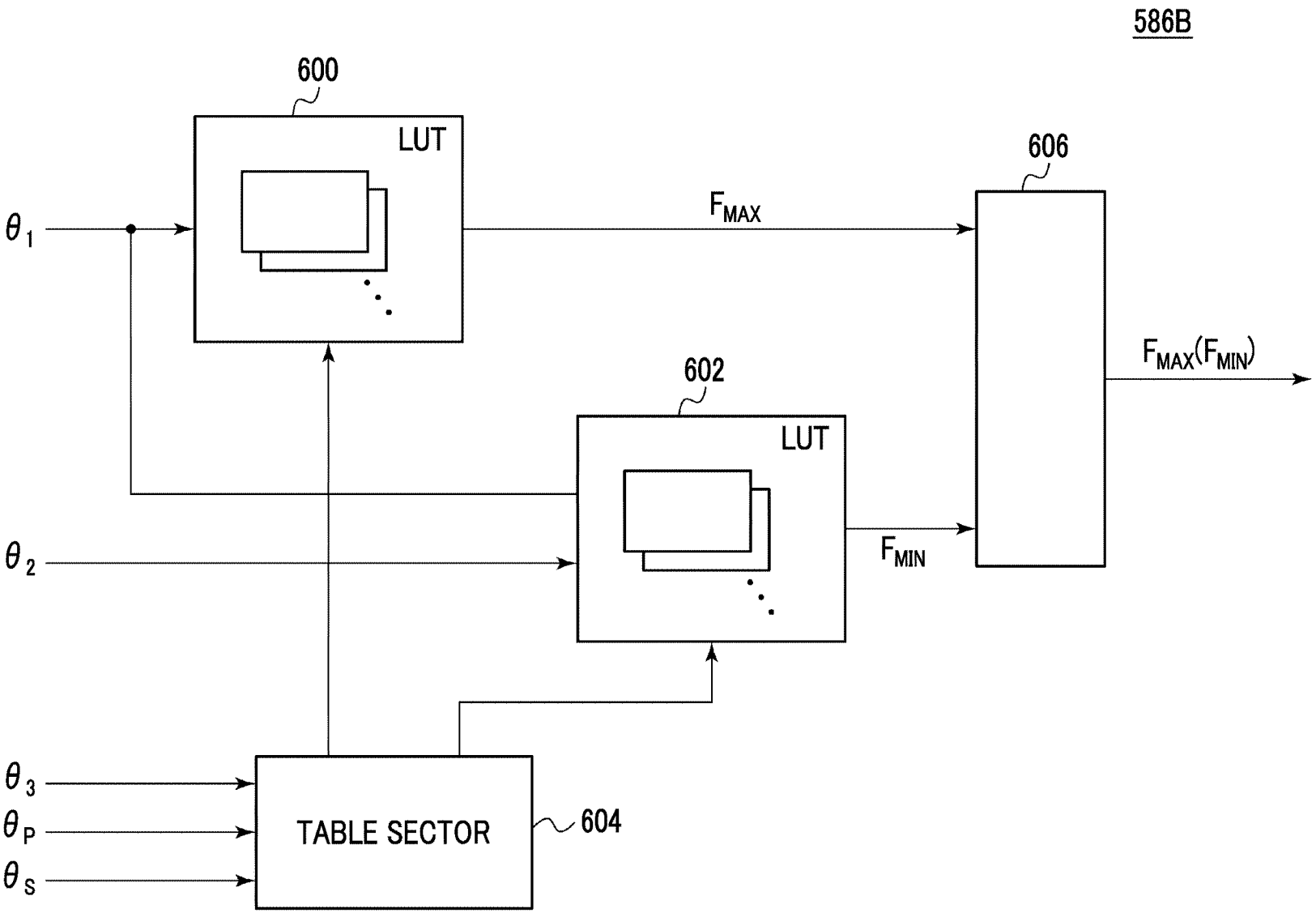
FIG. 8 is a block diagram of a limiting thrust force acquisition unit according to an embodiment.

FIG. 8 is a block diagram of a limiting thrust force acquisition unit 586B in accordance with an embodiment. The limiting thrust force acquisition unit 586B sets the limit thrust force $F_{MAX}$ based on a table reference. The limiting thrust force acquisition unit 586B includes a first look-up table 600, a second look-up table 602, a table selector 604, and a selector 606.

The first look-up table 600 has a boom angle $\theta_1$ as an input and has the limit thrust force $F_{MAX}$ as an output. The first look-up table 600 may include a plurality of tables provided corresponding to a plurality of different states of the excavator. The table selector 604 selects an optimum table using at least one of a bucket angle $\theta_3$, a pitch angle $\theta_P$ of the vehicle body, and a swing angle $\theta_S$ as a parameter.

The second look-up table 602 has the boom angle $\theta_1$ and an arm angle $\theta_2$ as an input and has the holding thrust force $F_{MIN}$ as an output. Similarly, the second look-up table 602 also may include a plurality of tables provided corresponding to a plurality of different states of the excavator. The table selector 604 selects an optimum table using at least one of the bucket angle $\theta_3$, the pitch angle $\theta_P$ of the vehicle body, and the swing angle $\theta_S$ as a parameter. The selector 606 outputs a larger one of the limit thrust force $F_{MAX}$ and the holding thrust force $F_{MIN}$. According to the limiting thrust force acquisition unit 586B, it is possible to suppress the vibration while preventing the lowering of the boom. According to this embodiment, it is possible to realize an optimal control at various postures of the excavator.

The limit thrust force $F_{MAX}$ may be acquired by arithmetic processing instead of the table reference. In addition, the holding thrust force $F_{MIN}$ may be acquired by arithmetic processing instead of the table reference. Meanwhile, even if the thrust force is not strictly controlled, it is possible to suppress the vibration by performing an outflow from the cylinder during a predetermined time or at a predetermined flow rate so that lowering of the boom which is not performed by the operation is restricted to a minimum position or speed.

Figure 9:
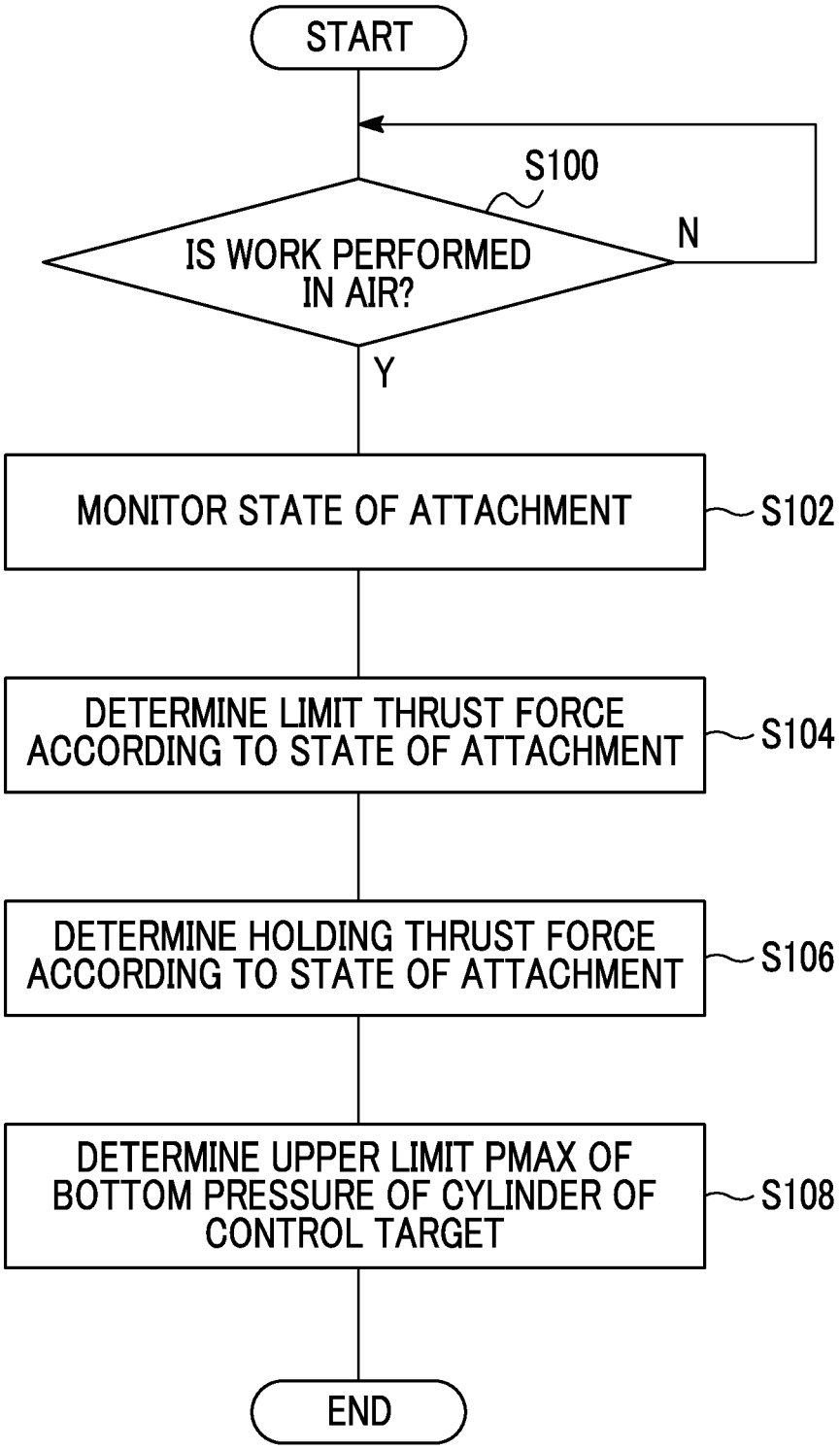
FIG. 9 is a flowchart of the vibration suppression of the excavator according to an embodiment.

FIG. 9 is a flowchart of the vibration suppression of the excavator 500 according to an embodiment. First, a load determination (work determination) is performed, and it is determined whether or not a work in air is performed (S100). In the load determination, it may be determined whether the work in air or a digging work is performed. This determination may be performed based on a distal position of the attachment, and for example, in an embodiment, the digging work may be determined when the position of the bucket is lower than a height defined based on the crawler (or ground) and the aerial operation may be determined when the position of the bucket is higher than the height. Alternatively, the digging work may be determined when a pressure of a hydraulic pump or a pressure of each cylinder is higher than a predetermined threshold, or, for example, based on the input to the operation lever, it may be determined that the digging work is performed while a bucket pulling operation or an arm pulling operation occurs.

When the work in air is not performed (N in S100), the processing is returned to processing S100 or is transferred to a processing sequence corresponding to the digging work. If it is in the digging work, another stabilization control in the digging work may be performed, or a stabilization control may be performed as a normal state. Alternatively, during the digging work, since the bucket is in contact with earth and sand, or the like, an abrupt operation of the attachment is less likely to occur as compared to that during the work in air, and thus, the stabilization control may not be performed. Rather, if it is easy to discharge oil from the cylinder, a holding-out force of the cylinder is reduced when the earth and sand are pulled in by the bucket, and thus, it can be said that it is preferable not to perform the stabilization control in the viewpoint of workability.

If it is determined that the work in air is performed (Y in S100), the state (for example, boom angle $\theta_1$, arm angle $\theta_2$, bucket angle $\theta_3$) of the attachment 510 is monitored (S102). In addition, the limit thrust force $F_{MAX}$ and the holding thrust force $F_{MIN}$ are determined according to the state of the attachment 510 (S104, S106). Moreover, the upper limit value $P_{MAX}$ of the bottom pressure of the control target is determined based on the limit thrust force $F_{MAX}$ and the holding thrust force $F_{MIN}$ (S108).

Figure 10:
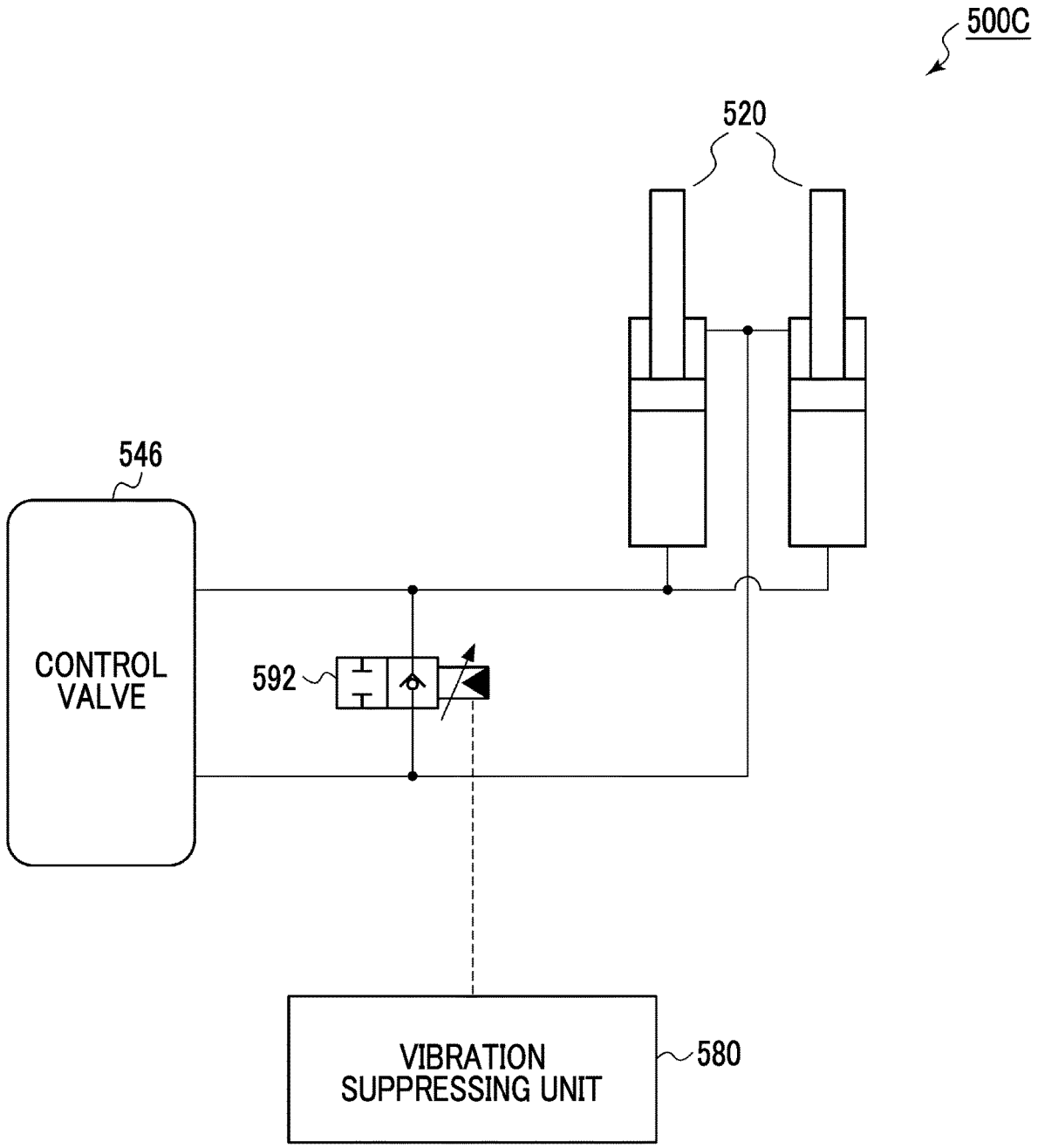
FIG. 10 is a block diagram related to a vibration suppression of an excavator according to an embodiment.

FIG. 10 is a block diagram related to a vibration suppression of an excavator 500C according to an embodiment. The excavator 500C includes an external regeneration valve 592 provided between the bottom chamber and the rod chamber of the control target cylinder (boom cylinder 520). The vibration suppressing unit 580 controls the external regeneration valve 592, and thus, controls the thrust force of the boom cylinder 520 such that the thrust force does not exceed the limit thrust force $F_{MAX}$. This configuration can also suppress the vibration.

Figure 11:
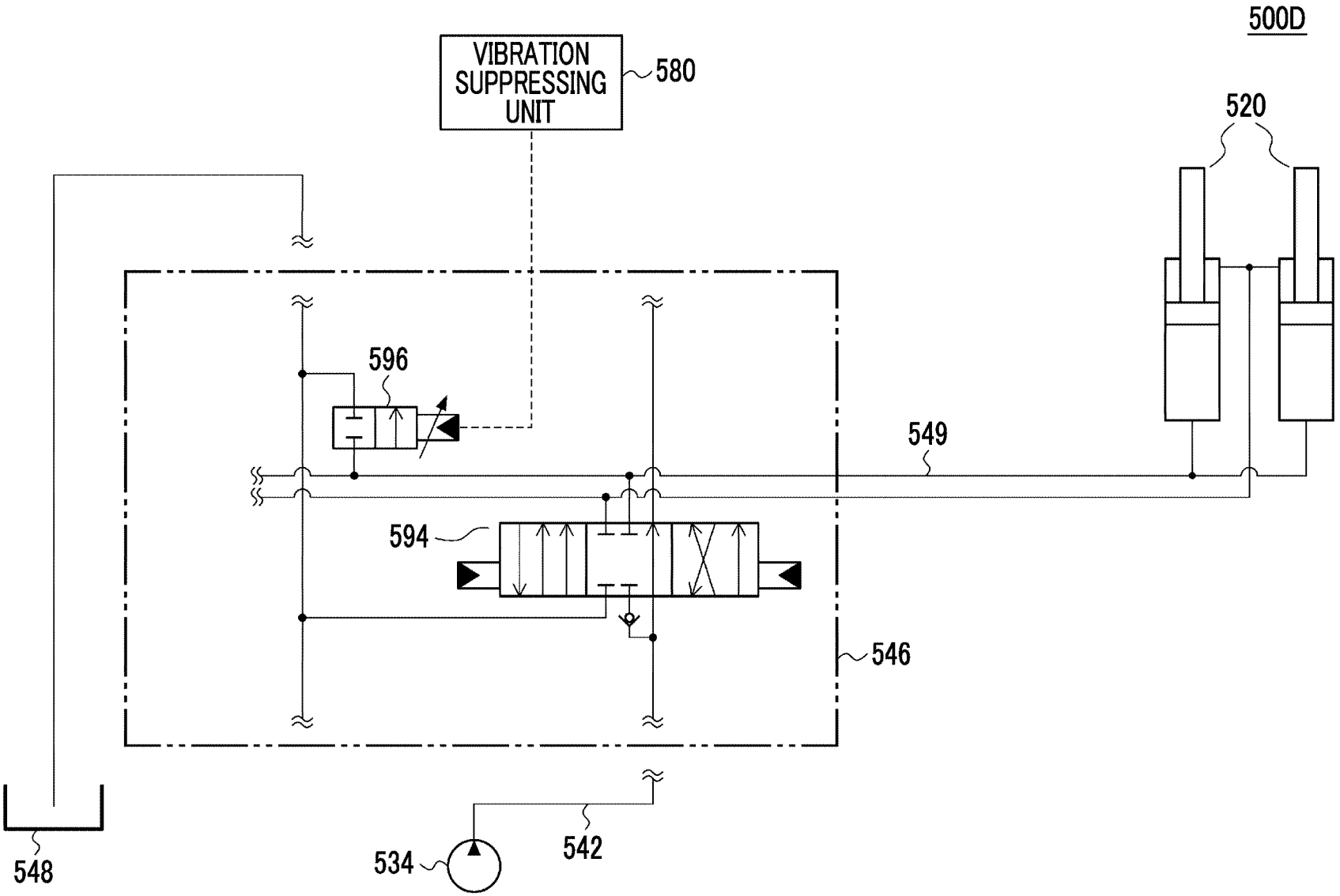
FIG. 11 is a block diagram related to a vibration suppression of an excavator according to an embodiment.

FIG. 11 is a block diagram related to a vibration suppression of an excavator 500D according to an embodiment. The control valve 546 includes a boom directional switching valve 594 and an electromagnetic proportional valve 596. The electromagnetic proportional valve 596 is provided in an oil passage 549 from the bottom chamber of the boom cylinder 520 to a tank chamber 548.

The vibration suppressing unit 580 controls the electromagnetic proportional valve 596, and thus, controls the thrust force of the boom cylinder 520 such that the thrust force does not exceed the limit thrust force $F_{MAX}$. This configuration can also suppress the vibration.

Hereinbefore, the present invention is described based on the embodiments. It is understood by a person skilled in the art that the present invention is not limited to the above-described embodiments, various design changes are possible, various modification examples are possible, and the modification examples are also within the scope of the present invention. Hereinafter, the modification examples will be described.

In the embodiments, the vibration is suppressed by controlling the pressure of the boom cylinder 520. However, the present invention is not limited to this, and in addition to this or instead of this, the vibration may be suppressed by controlling the pressures of the arm cylinder 522 or the bucket cylinder 524.

Moreover, in the embodiments, the example in which the pressure and the thrust force are controlled is described. However, the present invention is not limited to this. That is, any control may be adopted as long as the force vibrating the vehicle body in the pitching direction is prevented from propagating from the attachment to the traveling body or is reduced by absorbing the force generated by the aerial operation of the attachment, that is, the overturning moment, and in short, any control may be adopted as long as it is shifted to a state where oil easily flows out from the cylinder.

The excavator 500 may be switchable between a first state and a second state. The first state is a state in which the above-described vibration suppression operation is valid, and the second state is a state in which the vibration suppression is invalid. For example, the cab of the excavator 500 may include an interface (a button, a switch, a touch panel, or the like) for switching between the first state and the second state. For example, the second state is set by default, and when the operator desires, the first state may be switched to enable the vibration suppression. Alternatively, the excavator 500 may be automatically switched between the first state and the second state according to a use state (slipperiness of road surface, degree of inclination, or the like) of the excavator 500.

The above-described correction for suppressing the vibration is not limited to the work in air. That is, the correction may be performed when the excavator does not travel (non-traveling state) or when the excavator does not turn (non-turning state). The non-traveling state or the non-turning state may be determined based on a position of the operating lever, and in a case where an operating lever is in a neutral position or in a case where the operating shaft is substantially neutral, it can be determined as a non-operating shaft. For example, a case where shifting is performed from a full lever to a neutral state or a case where a movement to a substantially neutral range is performed is included.

Figure 12A:
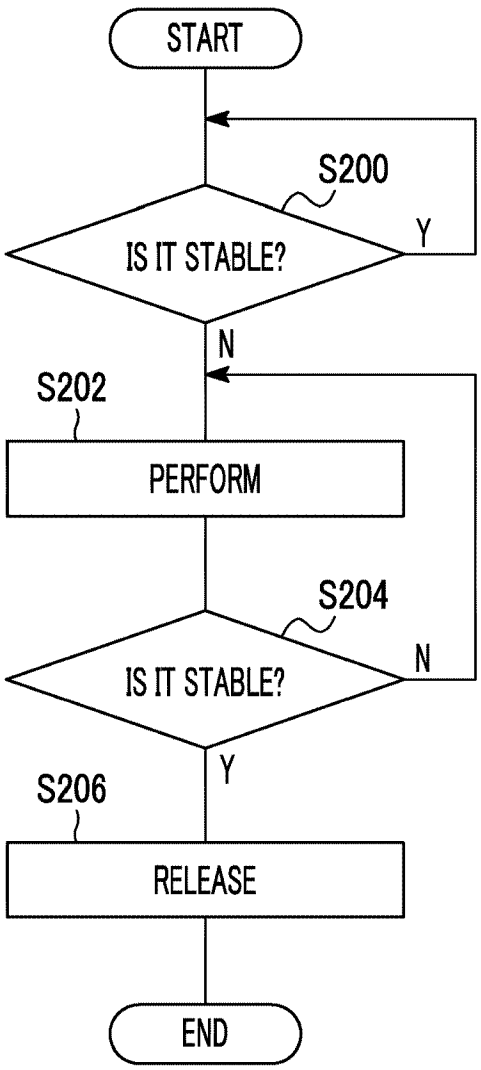
FIGS. 12A to 12C are flowcharts of vibration suppressing of an excavator according to a modification example.
Figure 12B:
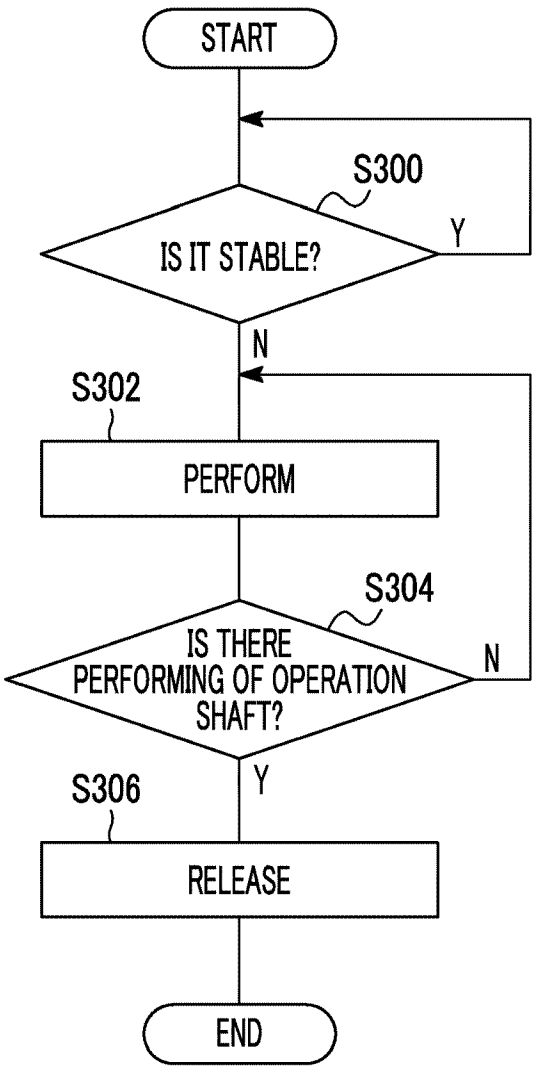
Figure 12C:
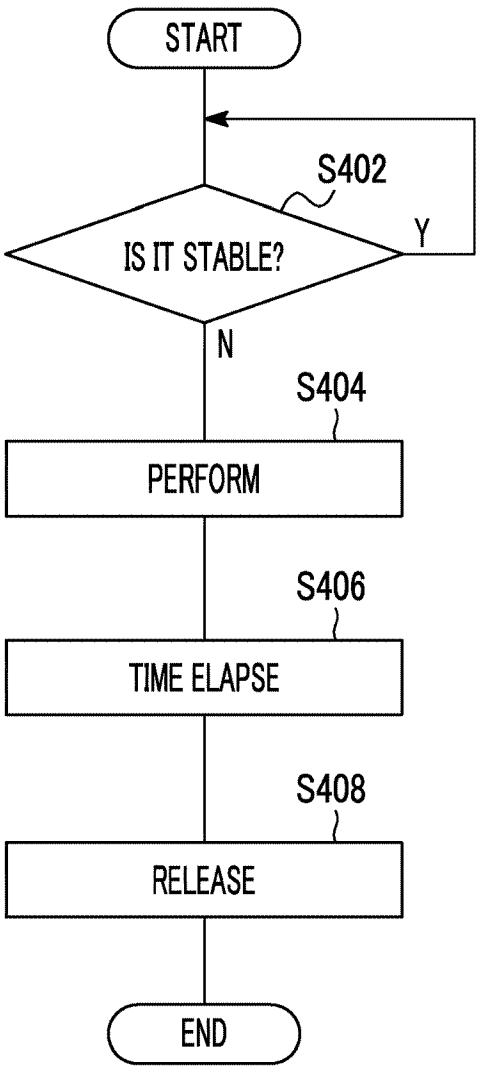

FIGS. 12A to 12C are flowcharts of vibration suppressing of an excavator according to a modification example.

In FIG. 12A, the controller determines whether or not it is stable at a predetermined control cycle based on acquired information (S200). If it is unstable, the vibration suppression or the correction for preventing overturning is performed (S202). Thereafter, the determination is repeated until it becomes stable (S204), and when it becomes stable, it is released. Because a condition in which stability is restored is set, the vibration prevention and the overturn prevention can be reliably performed.

In FIG. 12B, the controller determines whether or not it is stable at a predetermined control cycle based on acquired information (S300). In a case where it is unstable, the vibration suppression or the correction for preventing overturning is performed (S302). Thereafter, the release is performed according to a condition that a shaft subjected to the correction is operated. Since the operation is often performed when the operator feels stable, an operator's intuition is prioritized, and a balance between the stability and the workability can be achieved.

In FIG. 12C, the controller determines that whether or not it is stable at the predetermined control cycle based on the acquired information (S402). In a case where it is unstable, the vibration suppression or the correction for preventing overturning is performed (S404). Thereafter, it is determined that a predetermined time has elapsed (S404), and the release is performed (S408). The release condition is simplest, and thus, it is possible to reduce the arithmetic processing.

Figure 13A:
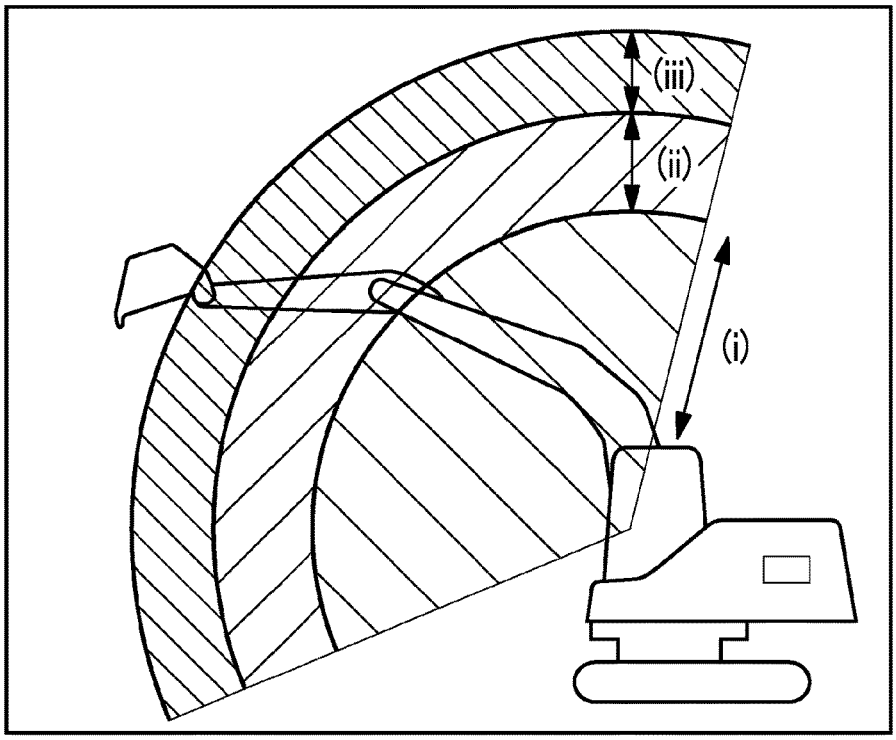
FIGS. 13A and 13B are diagrams for explaining a stability of a vehicle body.
Figure 13B:
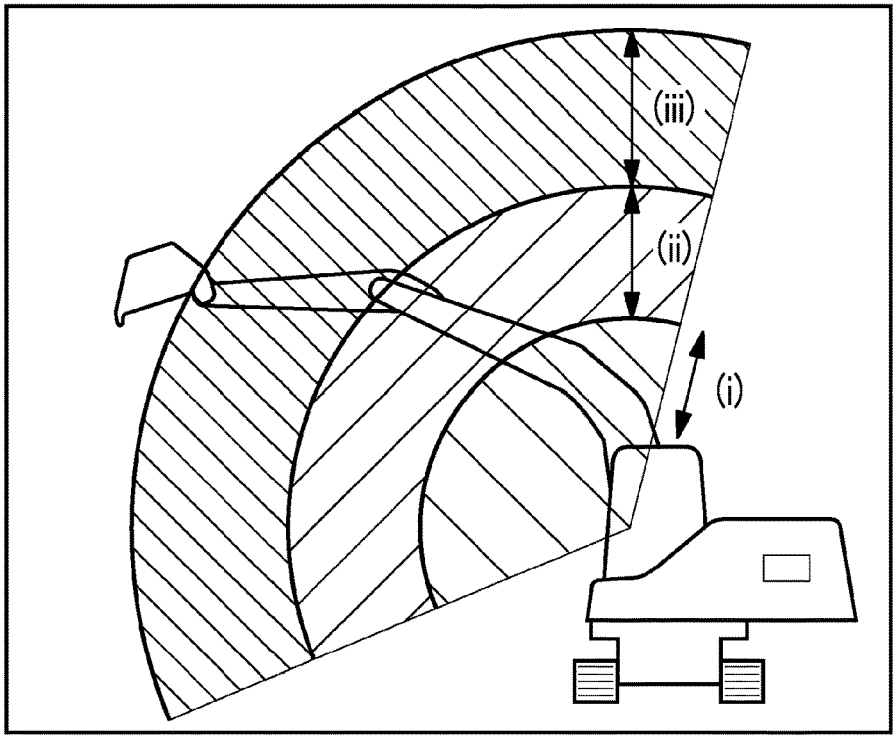

FIGS. 13A and 13B are diagrams for explaining the stability of the vehicle body. The stability of the excavator is changed according to the posture of the attachment. FIG. 13A shows a state where a turning angle is zero, and FIG. 13B shows a state where the turning body is turned by 90°.

A condition and amount of correction may be changed based on position information (height, or distance, or the like with respect to turning body) of the bucket or a relative angle between the lower traveling body and the turning body. In addition, a region which is unstable and a region which is not unstable in a case where the position of the bucket is present are set in advance, which may be used as a condition under which the correction functions. For example, when an earth removal is performed in a region (i) of FIG. 13A, the correction may not be effective because it is relatively stable, and the correction may be applied to regions (ii) and (iii) of FIG. 13A or all regions of FIG. 13B.

In the embodiments, the excavator is described. However, an application of the present invention is not limited to this, and the present invention can be used for a work machine such as a crane including a hydraulic work element which drives an attachment by a hydraulic cylinder. In addition, in addition to calculating the stability, based on presence or absence of an operation (operation for earth removal, lowering of the boom, opening of the arm to reach an arm maximum opening position, or the like) under which the stability decreases or an operation (an operation for abruptly shifting a lever neutral state from a full lever state or when a lever input speed is a predetermined speed or the like), the cylinder of the attachment is controlled, which is also effective. Alternatively, acceleration or vibration may be detected from the sensor provided in the attachment or/and the turning body, and the correction may be determined based on a determination that the vehicle body is vibrated or is vibrating. In any case, the cylinder is controlled so as to attenuate an external force transmitted from the attachment, and thus, the vibration or overturn of the vehicle body can be suppressed. The cylinder may be controlled based on the pitching information or acceleration information of the vehicle body acquired directly from the sensor, and the cylinder may be controlled based on the bucket position, attachment position information, the relative angle between the traveling body and the turning body, or the like without directly calculating the stability.

It should be understood that the invention is not limited to the above-described embodiment, but may be modified into various forms on the basis of the spirit of the invention. Additionally, the modifications are included in the scope of the invention.

The present invention is applicable to a work machine.

What is claimed is:

1. An excavator comprising:

a traveling body;

an upper turning body rotatably provided on the traveling body;

an attachment which has a boom, an arm, and a bucket and is attached to the upper turning body;

a plurality of cylinders that drive the attachment;

a hydraulic circuit that is connected to each of the plurality of cylinders and supplies oil to the cylinder in accordance with an amount of control;

a controller that controls the hydraulic circuit such that the cylinder absorbs an overturning moment produced due to a change in a moment of inertia of the attachment and applied from the attachment to the upper turning body, wherein the controller is structured to determine whether an aerial operation or digging work is being performed based on any one of distal position of the attachment, a pressure of a hydraulic pump or a pressure of each cylinder, and an input to an operation lever, and when the determination is made that the aerial operation is being performed, the controller performs said control.

2. The excavator according to claim 1, wherein, when a cylinder is operated, the controller absorbs the overturning moment by automatically controlling the cylinder not operated.

3. The excavator according to claim 1, wherein the controller changes a state between an oil chamber of a control target and the hydraulic circuit of the cylinder to a state where oil more easily flows.

4. The excavator according to claim 1, wherein the controller is operated such that a thrust force or a pressure of a control target cylinder does not exceed an upper limit value according to a state of the attachment.

5. The excavator according to claim 1, further comprising:

a valve connected to an oil chamber of a control target cylinder, wherein the controller controls the valve such that the cylinder absorbs the overturning moment.

6. The excavator according to claim 5, wherein the valve is an electromagnetic port relief valve provided in the oil chamber of a control target cylinder, and the controller controls the electromagnetic port relief valve.

7. The excavator according to claim 5, wherein the valve is a valve provided in a control valve, and the controller controls the control valve.

8. The excavator according to claim 5, wherein the valve is an external regeneration valve provided between the oil chamber and a further oil chamber of a control target, and the controller controls the external regeneration valve.

9. The excavator according to claim 5, wherein the valve is an electromagnetic control valve provided in an oil passage leading to a tank chamber from the oil chamber of a control target cylinder, and the controller controls the electromagnetic control valve.

10. The excavator according to claim 1, wherein a region defined to be unstable if a position of a bucket is present in the region is set in advance, and, when the position of the bucket is included in the region thus set, control by the controller is effective.

11. The excavator according to claim 1, further comprising:

a sensor provided in a vehicle body to acquire pitching information or acceleration information, wherein the controller causes control to be effective based on an output of the sensor.

12. The excavator according to claim 1, wherein control by the controller is effective when at least one of earth removal, lowering of the boom, and opening of the arm to reach an arm maximum opening position, under which stability decreases, is performed.

13. The excavator according to claim 1, wherein the controller performs control such that a control target cylinder is freely operated, thereby causing a moveable unit in the cylinder to move according to a change in the moment of the attachment so as to absorb a change by a movement.

14. An excavator comprising:

a traveling body;

an upper turning body rotatably provided on the traveling body;

an attachment which has a boom, an arm, and a bucket and is attached to the upper turning body;

a boom cylinder that drives the boom;

an arm cylinder that drives the arm;

a bucket cylinder that drives the bucket;

a hydraulic circuit that is connected to the boom cylinder, the arm cylinder and the bucket cylinder and supplies oil to the cylinders in accordance with an amount of control; and a controller that controls the hydraulic circuit such that the boom cylinder absorbs an overturning moment produced due to a change in a moment of inertia of the attachment and applied from the attachment to the upper turning body, wherein the controller performs said control when the boom cylinder is not operated and the arm cylinder and the bucket cylinder are operated.

15. An excavator comprising:

a traveling body;

an upper turning body rotatably provided on the traveling body;

an attachment which has a boom, an arm, and a bucket and is attached to the upper turning body;

a plurality of cylinders that drive the attachment;

a hydraulic circuit that is connected to each of the plurality of cylinders and supplies oil to the cylinder in accordance with an amount of control; and a controller that controls the hydraulic circuit such that the cylinder absorbs an overturning moment produced due to a change in a moment of inertia of the attachment and applied from the attachment to the upper turning body, wherein the controller performs said control when earth removal is performed, and wherein the earth removal is a movement from a state where the bucket and the arm are closed, the boom is raised, and the bucket accommodates a load, to a state where the bucket and the arm is widely opened so that the load is discharged.

* * * * *